United States Patent [19]

Lacoste et al.

[11] 4,439,471

[45] Mar. 27, 1984

[54] TENNIS BALL WITH FABRIC COVERING

[75] Inventors: François R. Lacoste, Neuilly sur Seine; Françoise M. H. Biard, Paris, both of France

[73] Assignee: Patentex S.A., Fribourg, Switzerland

[21] Appl. No.: 196,865

[22] Filed: Oct. 14, 1980

Related U.S. Application Data

[63] Continuation of Ser. No. 51,046, Jun. 22, 1979, abandoned, which is a continuation of Ser. No. 808,028, Jun. 20, 1977, abandoned.

[30] Foreign Application Priority Data

Jun. 21, 1976 [FR] France ..... 76 18777

[51] Int. Cl.[3] ..... A63B 39/00

[52] U.S. Cl. ..... 428/35; 273/61 R; 273/61 B; 428/85; 428/91; 428/280; 428/288; 428/300; 428/301

[58] Field of Search ..... 428/35, 85, 91, 280, 428/288, 300, 301; 273/61 R, 61 B

[56] References Cited

U.S. PATENT DOCUMENTS 3,396,970 8/1968 Fraser ..... 428/35

FOREIGN PATENT DOCUMENTS 1152240 5/1969 United Kingdom ..... 428/35

*Primary Examiner*—Marion McCamish

*Attorney, Agent, or Firm*—Merriam, Marshall & Bicknell

[57] ABSTRACT

A tennis ball conforming to the 1968 regulation of the International Federation of Lawn Tennis comprises a hollow elastic core and an improved cover bonded to the core by an adhesive mixture. The cover has a specific weight less than 0.22 g/cm$^3$ and includes a proportion of relatively thick monofilament fibers such that the percentage-weighted average denier size of all fibers in the cover is at least 18. The cover improves the playing characteristics and the effective life of the ball.

19 Claims, 2 Drawing Figures

TENNIS BALL WITH FABRIC COVERING

This is a continuation of application Ser. No. 051,046, filed June 22, 1979, now abandoned, which application is a continuation of application Ser. No. 808,028, filed June 20, 1977, now abandoned.

The present invention relates to a tennis ball in conformity with the regulations of 1968 of the International Federation of Lawn Tennis, said ball comprising an elastic hollow core and a textile covering fixed to the said core by an adhesive.

BACKGROUND OF THE INVENTION

The regulations of the International Federation of Lawn Tennis specify that tennis balls can only be endorsed and utilized for championships if they present:

a weight comprised between 57.71 and 58.47 g.

a diameter comprised between 6.35 and 6.67 cm., the ball not being able to drop by its own weight through a hole having a diameter of 6.54 cm., and being able to drop by its own weight through a hole having a diameter of 6.86 cm.

a rebound comprised between 134.6 and 147.3 cm., when the ball drops from a height of 254 cm. on a concrete slab.

Furthermore, the tennis balls must comply with deformation tests adapted to define the manner in which they behave in play, particularly when they are hit by the racket.

Up to 1968 a single deformation test was provided. With the aid of a so-called Stevens machine, it was to be determined whether, when a ball is subjected to a compression force of 8.165 kg., its crushing—its deformation—is comprised between 0.673 and 0.737 cm (0.265 and 0.290 inch).

At that time, the Federation of Lawn Tennis modified the conditions of this deformation test, the so-called "forward" test, by bringing to 0.56 cm. (0.220 inch) the minimum of "forward" deformation, and requiring that the measurements be made less than 2 hours after "precompression" tests, reducing the resistance to deformation.

At the same time, there was provided a second deformation test, the so-called "return" test, in which, immediately after a crushing of 2.54 cm., the ball while being subjected during its decompression to the same compression force of 8.165 kg., should have a deformation comprised between 0.89 and 1.08 cm (0.350 and 0.425 inches).

The Stevens machine comprises dials on which the numerals of deformation may be read in thousandths of an inch, and, in order to determine whether a ball complies with the regulations, it is necessary to check that the numerals indicated by the machine are comprised between 220 and 290 for the "forward" test and between 350 and 425 for the "return" test.

In order to be endorsed, all the balls, whether inflated or non-inflated, must satisfy these tests, comprising the modifications decided in 1968.

In 1968, the International Federation of Lawn Tennis was fully aware of the problems which the manufacturers were encountering in order to make non-inflated balls, preserving well enough their hardness or toughness, that is to say their resistance to deformation in the course of play. It is for this reason that the Federation of Lawn Tennis introduced the "return" test intended to show how the ball behaves after repeated deformations.

On the other hand, by lowering to 0.56 cm. the minimal "forward" deformation, the Federation permitted, however with a certain reluctance, the use of non-inflated balls offering the characteristic of being "very hard" when new so as to remain sufficiently hard in the course of play.

Despite the work of the Federation of Lawn Tennis to define the behavior of tennis balls and in spite of the endeavours of various manufacturers, the tennis balls actually manufactured are not completely satisfactory.

Inflated balls, i.e., those whose cores are inflated to a pressure greater than atmospheric pressure, rapidly lose their excess pressure. Within some months or even some weeks, their rebound capacity is reduced and they become too "soft", their deformation figures exceeding the maximum permitted. The play with such balls becomes too slow.

Non-inflated balls may be stored for a several months. However, after some games they lose a part of their "hardness", or resistance to deformation, and they cease to "respond" suitably when they are hit energetically. For example, it was determined that balls utilized in an important tennis tournament displayed deformation numerals (measured with the Stevens machine) as high as 280 and 460 after only nine games. Although these balls appear "hard" upon impact when they are new, they become much too "soft" after only nine games.

On the other hand, the behavior during play of all the types of balls is strongly affected by changes in the outer surface of their textile covering.

The analysis of the fibers constituting the outer surface of the textile coverings of the tennis balls most generally utilized has given the following results:

for inflated balls:

55% by weight of wool fibers,

45% of 6 to 20 denier nylon fibers:

for non-inflated balls:

58% of wool fibers,

32% of 15 denier nylon fibers,

10% of 25 denier viscose fibers.

Concerning these data, by definition, the weight in grams of 9000 meters of a fiber is its denier size.

Formerly, wool fibers agglomerated in such manner as to form a felted, very compact covering having a very smooth outer surface were utilized exclusively.

At the present time, textile coverings for tennis balls still comprise quite a great proportion of wool fibers, agglomerated in such manner as to impart a relatively smooth appearance to the outer surface of the new tennis balls which, as it is well known, are rather difficult to control.

However, their outer surface does not long remain smooth in the course of the game. With textile coverings such as those presently made, the ends of numerous fibers become disengaged from other fibers and stand up more or less perpendicularly to the outer surface of the ball, which gives it a more or less hairy or dishevelled appearance.

After extended play with such balls, particularly on hard or gravelly surfaces, the disengaged fibers wear or break off and, after several sets, the outer surface of these balls becomes smooth again while the weight and diameter of each ball are substantially reduced.

Aerodynamic tests carried out in a wind-tunnel have shown that while the new balls have a drag of 90 to 95 g., at a speed of 100 km. per hour, their drag could increase up to 105 or 110 g. after several games, then decrease again down to a value of the order of 85 g., or even less, when fibers were detached or worn.

It is known that the drag of a spherical body is given by the formula:

$$T=\frac{1}{2}p\cdot V^2\cdot S\cdot Cx,$$

in which p is the density of the air,

V the relative speed of the air and of the spherical body,

S the section of the spherical body, $S=(\pi d^2/4)$, d being the diameter, and

Cx a coefficient determined by the surface of the spherical body.

Considering a new ball having a diameter of 6.6 cm. and a smooth surface, with corresponding drag of 95 g. at 100 km. per hour, it would be necessary, if the condition of the surface of this ball remained unchanged, to increase its diameter to 7.10 cm. in order to obtain a drag of 110 g. and to reduce it to 6.24 cm. in order to obtain a drag of 85 g.

This means that if a player starts to play with a ball having a diameter of 6.6 cm., after several games, he has the impression that the diameter of the ball has increased to 7.10 cm. while, after several sets, he has, on the contrary, the impression that the diameter of the ball has decreased to 6.24 cm. and that its weight is also reduced.

Considering that the speed of 100 km. per hour is easily exceeded, for example in the case of serves, and that any modification of the drag is much more perceptible at higher speeds, it is not surprising that the players complain of meeting with difficulties in adjusting their strokes sufficiently, in order to preserve a correct length of said strokes in spite of the great differences in trajectory resulting from modifications in the behavior of the balls.

Of course, after several games, the softening of the core of a non-inflated ball combines with the increase in the drag of the ball to make the game very slow, while, when the fibers of the textile covering of a tennis ball are torn or worn, the loss in weight of the ball combines with the reduction of drag to make the play of this ball very rapid.

SUMMARY OF THE INVENTION

The tennis ball according to the present invention has characteristics completely in conformity with the regulations mentioned above (without excess hardness in the initial state), and in the course of the game, it maintains both its mechanical and aerodynamic characteristics better than the balls manufactured up to the present time.

The tennis ball according to the present invention comprises an elastic hollow core and a covering, bonded to the outer surface of said core by an adhesive mixture, said covering consisting of fibers, some of which are disposed substantially parallel to the outer surface of said core and others oblique or substantially perpendicular to the core outer surface, and a part at least of said fibers being monofilament synthetic fibers of at least one kind, such that the percentage-weighted average denier size of said fibers be at least 18.

DESCRIPTION OF THE PREFERRED EMBODIMENTS

Figure 1:
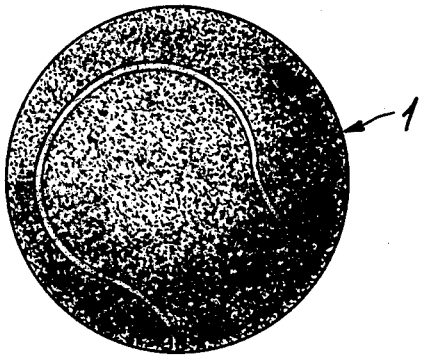
FIG. 1 is a front view of a tennis ball representing a typical embodiment of the invention.
Figure 2:
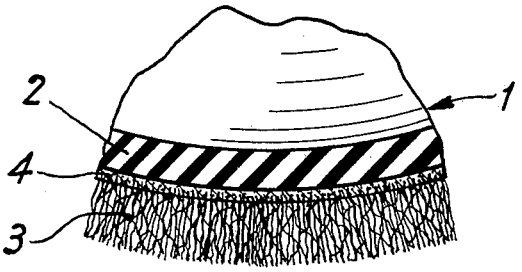
FIG. 2 is a cross-section of a part of the wall of the tennis ball of FIG. 1.

As shown in the drawings (FIGS. 1 and 2), the tennis ball 1 of the invention comprises an elastic, inflated or non-inflated hollow core 2 and a covering 3, several embodiments of which will be described in detail below. Covering 3 is bonded to the outer surface of said elastic core 2 by a layer 4 of a suitable adhesive mixture.

By way of example, several embodiments of the invention are described below.

There will be specified first the characteristics of the different types of fibers utilized in the textile coverings of the ordinary or usual tennis balls; it is recalled that the resistances to wear and rupture of a given fiber depend on its denier size. In the following table, the principal physical characteristics of the most common currently used fibers for this application are indicated:

| | wool | nylon | polyester | viscose |
|---|---|---|---|---|
| specific gravity | 1.31 | 1.14 | 1.38 | 1.52 |
| absorption of moisture | 16% | 5% | 0.4.% | 14% |
| breaking strength in grams per 1 denier | 1 to 1.7 | 4.5 to 7.5 | 4.7 to 6.5 | 1 to 1.5 |
| resistance to wear (compared with nylon) | 5 to 20 | 100 | 67 | 5 to 20 |

The principal reason for which the textile coverings of the ordinary tennis balls contain a high proportion of wool fibers in spite of their weak resistance to wear and rupture resides probably in their property of agglomerating and forming a compact enough layer and thus the smooth surface, the low drag and the great speed which characterize these balls when new. However, as explained above, the compactness of the surface layer of the ordinary balls does not last.

As the tennis balls according to the present invention are provided each with a covering comprising a significant percentage of rather thick and rigid synthetic fibers, these balls offer, when new, an outer surface which is a little more hairy than that of the usual tennis balls, but which is less modified by wear.

The tennis balls according to the present invention also offer aerodynamic characteristics which are more constant in the course of their total life time by reason of:

(1) a little higher drag when new, (2) a lower increase in drag after several games, and (3) a lower and slower reduction of the drag after long period of play, due to the high resistance to wear of the thick synthetic fibers which comprise the covering of a tennis ball according to the present invention.

As the covering of a tennis ball according to the present invention comprises a significant percentage of thicker synthetic fibers, and as said synthetic fibers are more rigid, said covering of a tennis ball according to the present invention has a much lower compactness than usual ball coverings. This makes it possible to give the covering of the balls according to the present invention either the same apparent thickness as the covering of ordinary balls while reducing the weight of this covering or a greater thickness, with equal weight. This allows in both cases, increasing the thickness of the wall of the rubber core without the tennis ball ceasing to be in conformity with the regulations of the International Federation of Lawn Tennis.

In the case of a ball with inflated core, such an increased thickness of the wall of its hollow core is advantageous because it permits increasing the impermeability of said wall and consequently the tightness of the core, whose internal excess pressure and conformity with the regulations of the International Federation of Lawn Tennis, which partially results from it, are preserved for a longer time.

In the case of a ball with non-inflated core, the possibility of increasing the thickness of the wall of the hollow rubber core has still more important advantageous consequences. In this case, in fact, the problem which arises is to obtain a sufficient resistance to deformation without reducing the rebound. When the degree of hardness, or resistance to deformation, which is desired is obtained by increasing the reinforcing additives in the mixture constituting the core, it is difficult to maintain the rebound sufficiently high. To the contrary, no loss on the rebound is obtained if the figures of deformation are reduced due to a thickening of the wall of the core, as can be seen from the following table, indicating the different values of the characteristics of molded cores prepared with identical mixtures, but offering increasing weights and thickness of wall:

| | Units: | | | | |
|---|---|---|---|---|---|
| 1. radius of the mold for the outer surface of the core | cm. | 3.085 | 3.085 | 3.085 | 3.085 |
| 2. radius of the mold for the interior surface of the core | cm. | 2.665 | 2.655 | 2.645 | 2.635 |
| 3. thickness of the wall of the core | cm. | .42 | .43 | .44 | .45 |
| 4. weight of the core | g. | 44.5 | 45.5 | 46.5 | 47.5 |
| 5. "forward" deformation | inch | .300 | .280 | .260 | .240 |
| 6. "return" deformation | inch | .400 | .380 | .355 | .330 |
| 7. rebound | cm. | 164 | 164 | 166 | 166 |

These figures show that increases of 3 grams in the weight of the core and of 0.03 cm. in the thickness of its wall reduce the "forward" deformation by about 0.06 inches (approximately 0.15 cm.), this reduction being almost equal to the difference of 0.07 inches (approximately 0.16 cm.) between the maximal and minimal values provided by the regulations for the outer semi-diameter of the ball.

On the other hand, the present invention leads to another advantage, still more important, and utterly surprising: in the case of the ordinary tennis balls—whether inflated or not—the initial value of the "forward" deformation, measured with the Stevens machine, is less than the measured value of the same deformation of the core of these balls; in the case of a tennis ball according to the present invention, provided with a textile covering comprising a certain proportion of thick and rigid synthetic fibers, the initial value of the "forward" deformation of the ball is not lower than the same deformation of its core, but may even be greater. This advantage results directly from the lower specific gravity and greater damping factor of the covering of the ball according to the present invention. This advantage may also be increased by increasing the proportion of adhesive—flexible and shock absorbing—which is utilized in the ball according to the present invention in order to impregnate on a certain thickness, its covering as well as in order to bond it to the core; this increase in the weight of the adhesive is made possible by the reduction of the weight of said covering, so that the ball according to the present invention remains in conformity with the regulations of the International Federation of Lawn Tennis. In other words, in the case of a tennis ball according to the present invention offering substantially the same hardness, that is to say, the same "forward" deformation as its own core, there is reduction in the feeling of hardness which is experienced when said ball is hit with a racket, on account of the very effective damping obtained in this way. The difference in feeling thus perceived is further confirmed in a surprising manner by the difference in the respective noises of impact of the ordinary balls and of the ball according to the present invention, these latter being noticeably deadened or muffled.

The deformation figures of the non-inflated balls according to the present invention offer the greatest interest for the solution of the difficulties in making non-inflated balls that the International Federation of Lawn Tennis had clearly perceived when it decided in 1968 to modify its regulations, by reducing from 0.673 to 0.560 cm (0.265 to 0.220 inch) the minimum deformation figure.

While, with the usual coverings, the best non-inflated balls often have a "forward" deformation less than the new minimum of 0.560 cm (0.220 inch), it is possible by the present invention to manufacture good non-inflated tennis balls with "forward" deformations barely less than the former minimum of 0.673 cm. (0.265 inch), which the International Federation of Lawn Tennis had reluctantly agreed to reduce in 1968.

While the ordinary ball coverings allow only with difficulty the manufacture of very good non-inflated balls just as pleasing as inflated balls, the use of a covering according to the present invention unexpectedly gives non-inflated balls the characteristics and behavior during play which inflated balls have.

Of course, the proportions and the dimensions of the thick synthetic fibers which are comprised in the covering of the tennis balls according to the present invention as well as the total weight of this covering may easily be adjusted in order to obtain different types of balls, offering slightly different characteristics according to the uses or applications contemplated. If it is desired for example to make a ball offering a high degree of damping with a rather high "forward" deformation, it is preferable either to utilize a covering almost as heavy as the ordinary coverings, and constituted principally by very thick fibers, or to take advantage of the greatest part of the economy made in the weight of the covering in order to increase the proportion of flexible and damping adhesive. If, in contrast, it is desired to make a non-inflated ball offering low deformation figures and a very high rebound, it is preferable to utilize a lighter covering comprising somewhat smaller fibers and to take advantage of the greatest part of the economy achieved in the weight of the covering in order to increase the weight and the thickness of the wall of the core. Balls of the first type which have just been indicated will be "slow" balls, easy to control, with which there is a surprising reduction in the feeling of hardness experienced particularly when the ball comes into contact with a non-central part of the stringing of a tennis racket. This type of ball is very useful for beginners or indeed for playing on so-called "rapid" surfaces. In contrast, balls of the second type will be "rapid" balls, and they will remain so, much better than the ordinary non-inflated balls. They respond well to strong hits. They will be excellent balls for an "aggressive" game on so-called "slow" surfaces. Of course, the present invention allows the manufacture of types of balls intermediate between the two extreme types which have just been specified.

There will now be described in detailed manner five embodiments of the invention.

EMBODIMENTS I AND II

These two embodiments comprise hollow cores in two parts, each of which is manufactured by molding a suitable quantity of the following composition:

| | |
|---|---|
| natural rubber | 100 parts by weight |
| stearic acid | .5 parts by weight |
| zinc carbonate | 5 parts by weight |
| sulphur | 3.5 parts by weight |
| urea-formaldehyde resin | 27 parts by weight |
| diethylene glycol | 1.5 parts by weight |
| phenyl-β-naphtylamine | 2 parts by weight |
| N—cyclohexyl-2-benzothiazyl-sulpheneamide | .8 parts by weight |
| tetramethyl-thiurame-disulphide | .4 parts by weight |
| vanillin | .05 parts by weight |

Each half-core is then vulcanized at 145° C., under a pressure of about 35 kg/cm$^2$, for 4.5 minutes. Then a suitable adhesive is applied, for example, a solution of the above mixture, on the edges of the two half-cores, and they are assembled by submitting them in a mold to a temperature of 145° C. for 5 minutes.

The spherical core which has been obtained in this manner is then covered on the surface with an adhesive having for example the following composition:

| | |
|---|---|
| natural rubber | 100 parts by weight |
| zinc oxide | 5 parts by weight |
| titanium oxide | 5.5 parts by weight |
| sulphur | 2 parts by weight |
| zinc mercaptobenzimidazolate | 1 parts by weight |
| dibutyl para cresol | 1 parts by weight |
| N—cyclohexyl-2-benzothiazylsulfeneamide | 1.2 parts by weight |
| tetramethyl-thiurame-disulphide | .8 parts by weight |

On the other hand, a piece of covering is prepared, for example, by the well-known technique of needle-punching, which is simple and not very expensive. This piece of covering comprises:

in the embodiment I: 80% of monofilament polyester fibers, notably Grilene (registered trade-mark), of 20 deniers.

20% of monofilament polyester fibers, for example Tergal (registered trade-mark), of 45 deniers;

in the embodiment II: 100% of monofilament polyester fibers (for example Grilene) of 20 deniers, impregnated with 80 g/m$^2$ of a flexible acrylic resin such as Protex Am 133.R.

These different fibers having all a breaking strength greater than 4 g/denier.

It will be noted that the percentage-weighted average denier size of the covering is, for embodiment I:

$$0.80\times20+0.20\times45=25$$

while, for embodiment II, it is:

$$1.00\times20=20.$$

It will also be noted that, to the contrary, for the coverings of the ordinary balls mentioned herein above, the same percentage-weighted average denier size is, at the maximum, for inflated balls:

$$0.45\times20=9$$

and, for non-inflated ball, it is:

$$0.32\times15+0.10\times25=7.3.$$

The back of the piece of covering made in this way is covered with adhesive having the above composition, then is cut into two pieces, in figure eight form, of suitable dimensions to form the covering of the ball; however, the edges of the pieces in figure eight form are impregnated with a somewhat different composition, containing 15 parts of titanium oxide, instead of 5.5 parts and, besides, 7 parts of an aminoplastic resin powder, in order that the joinings of the two parts of the covering of the ball appear whiter and resist better to abrasion. The pieces, in figure eight form, thus coated with adhesive, are then applied to the outer surface of the hollow core, itself coated with adhesive, then the assembly is placed in a mold where it is subjected to a vulcanization operation at a temperature of 135° C. for 5 minutes.

For two balls of the same total weight, for example 58 g., the respective weights of the different constituents are the following:

| | Embodiment I | Embodiment II |
|---|---|---|
| core | 47.5 g | 47.5 g |
| fibers | 4.7 g | 4.7 g |
| impregnation product | 0 | 1.0 g |
| adhesive | 5.8 g | 4.8 g |
| TOTAL WEIGHT | 58.0 g | 58.0 g |

The ball of embodiment I contained therefore 5.8 g. of adhesive, and the ball of embodiment II, 4.8 g. while the ordinary balls generally do not comprise more than 3 to 4 g. of adhesive. The quantity, a little greater, of adhesive of suitably reduced concentration which impregnates the back side of the covering, penetrates between the fibers of this latter much more deeply than it is possible in the more compact surface of the ordinary coverings, consisting essentially of wool fibers and fine synthetic fibers.

The balls of embodiments I and II comprise in fact three superimposed layers: the inner layer is the wall of the hollow core; the outer layer is essentially made of thick synthetic fibers, more or less free, which consequently are oblique or substantially perpendicular to outer surface of the core, and which give the ball a slightly rough and hairy appearance; finally the intermediary layer, which is thicker than that of ordinary balls, is a flexible agglomeration of certain parts of the fibers with the above-mentioned adhesive, and with the impregnation resin; this adhesive and this resin were given by way of example only and can be replaced by other adhesives and other synthetic or natural impregnation products, such as latex. It must be further emphasized that fibers in said intermediary layer are substantially parallel to the outer surface of the ball core. The respective disposition of the fibers in said outer and intermediary layers may also be the same, if the needle-punched covering is replaced by a usual textile covering, for instance a woven covering, which is within the scope of the present invention.

Play tests of long duration with the balls of embodiments I and II have shown that their outer surface, being slightly rough and hairy, reduces effectively, as desired, the initial value of the speed in flight of the ball when new, while, later-on, there is less accentuation of the hairy appearance than with the ordinary balls. This is due to the fact that the fibers, being thicker, more rigid and better held by the adhesive—and by the impregnation resin in the case of embodiment II—do not detach themselves too easily from the ball and from each other. Finally, the thick and rigid synthetic fibers which comprise the covering of the balls according to the present invention, wear and break less easily than wool fibers and than the less numerous and finer synthetic fibers of the covering of ordinary tennis balls. After two hours of play, the balls of embodiments I and II had undergone respectively losses in weight of 0.39 g. and 0.32 g., while three balls having the same cores, but with ordinary coverings, had undergone in the same time losses in weight notably greater, respectively equal to 1.32 g., 1.33 g. and 0.94 g.

After three hours of a very hard play on a very rough surface, the balls of embodiments I and II had undergone respectively losses in weight of 0.98 g. and 1.18 g., while an ordinary ball, of a well known mark, had undergone a loss in weight of 1.91 g.

On the other hand, with cores of a weight of 47.5 g., having a relatively thick wall, these embodiments collapse little in play even under a violent racket stroke and behaved practically like inflated balls.

EMBODIMENTS III AND IV

The cores of these balls are manufactured by the process previously indicated, starting with a composition which does not differ from that utilized for embodiments I and II, except that it comprises 26 parts of resin, permitting the obtention of less hard cores.

The respective compositions of the coverings are the following:

EMBODIMENT III

70% by weight of nylon fibers of 15 deniers,
30% of nylon fibers of 40 deniers, and
50 g/m$^2$ of an acrylic resin impregnating the said fibers.

EMBODIMENT IV

60% by weight of nylon fibers of 15 deniers,
30% of nylon fibers of 40 deniers,
10% of fusible nylon fibers (marketed under the trade mark Grilon) of 6 deniers.

All these fibers having a breaking strength greater than 4 g per denier.

It will be noted that the percentage-weighted average denier size of the covering is, for embodiment III:

$$0.70\times15+0.30\times40=22.5$$

and, for embodiment IV, it is:

$$0.60\times15+0.30\times40+0.10\times6=21.6.$$

In the case of embodiment IV, the piece of covering was heated, before cutting the pieces into the form of a eight, to a temperature greater than the melting temperature of the fusible nylon fibers (115° C.) in order to improve the cohesion of the said covering without increasing its specific gravity.

As in the case of embodiments I and II, previously considered, the coverings of embodiments III and IV have been executed by the technique of needle-punching, but at the rate of 80 needle passages per cm$^2$ (instead of 60 in the case of embodiments I and II).

For the balls of embodiments III and IV, each weighing 58 g., the different constituents had the following weights:

| | Embodiment III | Embodiment IV |
|---|---|---|
| core | 46.2 g | 46.2 g |
| fibers | 6.7 g | 7.0 g |
| impregnation product | .6 g | — |
| adhesive | 4.5 g | 4.8 g |
| TOTAL WEIGHT | 58.0 g | 58.0 g |

The play tests with the balls of embodiments III and IV have given the same results as with the balls of embodiments I and II; the increase in the number of needle passages of the coverings of embodiments III and IV results however in a less hairy outer appearance of the corresponding balls, this appearance being better preserved in the course of play.

After two hours of play, the balls corresponding to the embodiments III and IV had undergone losses in weight of 0.53 g and 0.52 g. respectively while a ball of a well-known U.S. trade-mark had undergone a loss of weight of 0.70 g.

EMBODIMENT V

The core of this ball is manufactured like those of the preceding embodiments but with a composition of mixture adjusted in order to obtain the desired characteristics of deformation with a less thick wall and a weight of 44.3 g. only.

The covering is composed of fibers identical with those of embodiment III with a little more impregnation resin, 60 g./m$^2$ instead of 50 g./m$^2$ of covering, and also formed by needle punching, the number of needle passages having been brought to 150 per cm$^2$ instead of 80 per cm$^2$.

The composition of the ball is then the following:

| Embodiment V: | |
|---|---|
| core | 44.3 g. |
| fibers | 5.2 g. |
| impregnation product | .7 g. |
| adhesive | 6.8 g. |
| TOTAL WEIGHT | 57 g. |

In this embodiment, the reduced weights of the core and of the fibers have allowed bringing the weight of the impregnation product and adhesive to 0.7+6.8=7.5 g.

After four hours of play, the loss in weight was found to be less than 0.3 g., while the feeling of damped contact was very clear, the slight increase in hardness due to the increased needle-punching being compensated by the increased thickness of the layer of flexible adhesive mixture between the core and the covering and between the fibers of the internal part of the covering.

Systematical measurements of the deformation figures were made with the Stevens machine on two ordinary balls, one inflated and the other non-inflated, and on a number of non-inflated balls according to the present invention, which corresponded respectively to the embodiments I, II, III, IV and V, previously described; the results obtained were compared with the "thicknesses" of the respective coverings of these different balls; this "thickness" was defined as the difference between the radius of the largest hole through which the ball could not drop by its own weight, on the one hand, and the radius of the outer surface of its core, on the other hand. (See table, following pages).

TABLE

| | Units | Ordinary inflated ball | Ordinary non-inflated ball | Embodiment I | Embodiment II | Embodiment III | Embodiment IV | Embodiment V |
|---|---|---|---|---|---|---|---|---|
| Outer radius of the ball R(1) | cm | 3.32 | 3.31 | 3.36 | 3.37 | 3.36 | 3.37 | 3.31 |
| Outer radius of the core r | cm | 3.09 | 3.07 | 3.04 | 3.04 | 3.04 | 3.04 | 3.04 |
| Thickness of covering | cm | .23 | .24 | .32 | .33 | .32 | .33 | .27 |
| Weight P of fibers of covering | g. | 10 | 9.5 | 4.7 | 4.7 | 6.7 | 7 | 5.2 |
| "Forward" deformation a of the core | inches | .320 | .240 | .195 | .190 | .203 | .228 | .220 |
| "Return" deformation b of the core | inches | .380 | .365 | .302 | .285 | .313 | .335 | .300 |
| "Foward" deformation c of the ball | inches | .245 | .215(2) | .260(3) | .255(3) | .255(3) | .240(3) | .235 |
| "Return" deformation d of the ball | inches | .338 | .338 | .378 | .355 | .350 | .378 | .330 |
| Difference (c − a) | inches | −.075 | −.025 | +.065 | +.065 | +.052 | +.012 | +.015 |
| Difference (d − b) | inches | −.042 | +.023 | +.076 | +.070 | +.037 | +.043 | +.030 |
| Specific weight ρ of the covering (4) | g/cm³ | .336 | .31 | .114 | .110 | .162 | .164 | .152 |

(1) R being the radius of the largest hole through which the ball does not drop by its own weight
(2) Less than the actual minimum, therefore outside of the regulations
(3) Close to the former minimum (.265 inch) and to the figures obtained with good inflated balls
(4) $\rho = \frac{P}{4/3.\pi\,(R^3 - r^3)}$ The last line of the above table shows that the covering of the balls according to the present invention are much less dense and compact than those of the ordinary balls.

The figures of "forward" deformation which were obtained result from this reduction in density of the covering of the balls according to the present invention and from the damping effect due to the increase in the proportion of flexible adhesive, which is authorized by the economy in weight on the covering itself.

Although comprising much harder cores than those of ordinary balls, inflated or non-inflated, the five embodiments of balls according to the present invention have respective "forward" deformation figures of the same order or a little higher than the ordinary non-inflated ball, but clearly higher than the ordinary non-inflated ball, and this shows that these balls are in fact less hard than the ordinary balls.

Tests in play confirm entirely that the feeling of hardness or excessive hardness, which were experienced with the ordinary non-inflated balls, when new, were strongly reduced with the balls according to the present invention, and by contrast, the feeling of crushing which was experienced with the same ordinary balls having been subjected to intensive play is also reduced; it is characteristic and surprising that the noise of impact which may be noted with ordinary non-inflated balls is diminished in an appreciable manner when such a ball is provided with a covering according to the present invention.

What we claim is:

1. A tennis ball comprising a hollow elastic core, a textile covering, and an adhesive bonding said covering to said core, said covering comprising fibers including monofilament synthetic fibers, the percentage-weighted average denier size of all fibers in said covering being at least 18;

the specific weight of all said fibers in the volume comprised between the outer surface of said core and the outer surface of said ball being less than 0.22 g/cm³.

2. A tennis ball according to claim 1 wherein all of the fibers of said textile covering are monofilament synthetic fibers.

3. A tennis ball according to claim 1 wherein said core is inflated with a gas at superatmospheric pressure.

4. A tennis ball according to claim 1 wherein said core contains a gas at substantially atmospheric pressure.

5. A tennis ball according to claim 1, wherein at least 25% by weight of the synthetic fibers in the covering have a denier size larger than 35.

6. A tennis ball comprising a hollow elastic core, a textile covering, and an adhesive bonding said covering to said core, said covering comprising fibers including monofilament synthetic fibers, the percentage-weighted average denier size of all fibers in said covering being at least 18;

the specific weight of all said fibers in the volume comprised between the outer surface of said core and the outer surface of said ball being not greater than 0.164 g/cm³.

7. A tennis ball according to claim 6 wherein all of the fibers of said textile covering are monofilament synthetic fibers.

8. A tennis ball according to claim 7 wherein said specific weight has a value in the range of 0.110 to 0.164 g/cm$^3$.

9. A tennis ball according to claim 6 wherein said core is inflated with a gas at superatmospheric pressure.

10. A tennis ball according to claim 6 wherein said core contains a gas at substantially atmospheric pressure.

11. A tennis ball according to claim 6, wherein the weight of the fibers in the covering is comprised between 4 and 8 grams.

12. A tennis ball according to claim 6, wherein the total weight of the adhesive mixture and the impregnation product of the covering fibers is comprised between 4 and 8 grams.

13. A tennis ball according to claim 6, wherein a part at least of the synthetic fibers in the covering are polyamide fibers.

14. A tennis ball according to claim 6, wherein a part at least of the synthetic fibers in the covering are polyester fibers.

15. A tennis ball according to claim 6, wherein a part at least of the synthetic fibers in the covering are thermoplastic fibers with low melt point.

16. A tennis ball according to claim 6, wherein the fibers in the covering are impregnated with flexible, natural or synthetic products.

17. A tennis ball according to claim 16, wherein the impregnation product is a resin.

18. A tennis ball according to claim 16, wherein the impregnation product is a solution of synthetic or natural rubber.

19. A tennis ball according to claim 16, wherein the impregnation product is a latex.

* * * * *